US006335137B1

(12) United States Patent
Suzuki et al.

(10) Patent No.: US 6,335,137 B1
(45) Date of Patent: Jan. 1, 2002

(54) ELECTROPHOTOGRAPHIC TONER AND ELECTROPHOTOGRAPHIC IMAGE FORMING METHOD AND APPARATUS USING THE TONER

(75) Inventors: Masanori Suzuki, Shizuoka-ken; Hiroaki Matsuda; Akemi Sugiyama, both of Numazu; Hiroto Higuchi, Shizuoka-ken; Tsunemi Sugiyama, Numazu, all of (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/597,425

(22) Filed: Jun. 19, 2000

(30) Foreign Application Priority Data

Jun. 17, 1999 (JP) ..... 11-170396
Oct. 5, 1999 (JP) ..... 11-283641

(51) Int. Cl.[7] ..... G03G 9/00

(52) U.S. Cl. ..... 430/110.1; 430/111.1; 430/120; 399/252

(58) Field of Search ..... 430/110, 111, 430/120, 110.1, 111.1; 399/252

(56) References Cited

U.S. PATENT DOCUMENTS 5,130,219 A * 7/1992 Mori et al. ..... 430/110
5,547,801 A * 8/1996 Suzuki et al. ..... 430/111
5,614,347 A 3/1997 Aoki et al. ..... 430/109
5,976,752 A * 11/1999 Matsunaga et al. ..... 430/111
6,057,073 A * 5/2000 Hagiwara ..... 430/110

FOREIGN PATENT DOCUMENTS

| | | |
|---|---|---|
| EP | 0 259 819 | 3/1988 |
| EP | 0 331 393 | 6/1989 |
| JP | 03 188468 | 8/1991 |
| JP | 08 123080 | 5/1996 |
| JP | 09 120176 | 5/1997 |
| JP | 11 024312 | 1/1999 |

OTHER PUBLICATIONS

Derwent Publications, AN 1991–284984, JP 03 188468, Aug. 16, 1991.
Derwent Publications, AN 1999–170937, JP 11 024312, Jan. 29, 1999.
Derwent Publications, AN 1996–291427, JP 08 123080, May 17, 1996.
Derwent Publications, AN 1997–307725, JP 09 120176, May 6, 1997.

* cited by examiner

*Primary Examiner*—Mark Chapman
(74) *Attorney, Agent, or Firm*—Oblon, Spivak, McClelland, Maier & Neustadt, P.C.

(57) ABSTRACT

An electrophotographic toner including at least a binder resin, a colorant, and a releasing agent, wherein the binder resin includes one or more components soluble in tetrahydrofuran, and wherein the one or more components has a molecular weight distribution such that at least one peak is present between 1,000 and 10,000, and the peak has a half width not greater than 15,000 when the molecular weight is measured by a gel permeation chromatography (GPC) method.

20 Claims, 1 Drawing Sheet

ELECTROPHOTOGRAPHIC TONER AND ELECTROPHOTOGRAPHIC IMAGE FORMING METHOD AND APPARATUS USING THE TONER

BACKGROUND OF THE INVENTION

1. Field of the Invention

The present invention relates to an electrophotographic toner useful for developing an electrostatic latent image formed by electrophotography, electrostatic recording methods, electrostatic printing methods and the like methods, and electrophotographic image forming method and apparatus using the toner.

2. Discussion of the Background

Various electrophotographic image forming methods have been disclosed in U.S. Pat. No. 2,297,691, Japanese Patent Publications Nos. 49-23910 and 43-24748. The methods typically include the following processes:

(1) the surface of an image bearing member (a photoreceptor) is charged (charging process);

(2) the image bearing member is exposed to light to form an electrostatic latent image thereon (latent image forming process);

(3) the latent image is developed with an electrophotographic toner to form a toner image on the image bearing member (developing process);

(4) the toner image is transferred onto a receiving material (transferring process); and (5) the toner image on the receiving material is fixed upon application of heat, pressure, solvent vapor, or combination thereof to prepare a copy image (fixing process).

The method for developing electrostatic latent images is broadly classified into the following methods:

(1) wet developing methods using a liquid developer including a fine color pigment or dye dispersed in a liquid: and (2) dry developing methods such as cascade methods, magnetic brush methods and powder cloud methods, which use a developer (toner) including a colorant such as carbon black dispersed in a resin.

Recently the dry developing methods are widely used.

As the method for fixing toner images, methods using a heat roller are widely used because of having good energy efficiency. Recently, the heat energy used for fixing toner images becomes smaller and smaller because of performing high speed reproduction and saving energy. In addition, it is needed to decrease the warming-up time, i.e., the time from a waiting state of an image forming apparatus for copying to a working state of the apparatus in which a copy can be reproduced, while the electric power consumption of the apparatus is minimized in the waiting state to protect environment. In the DSM (Demand-side Management) program of IEA (International Energy Agency), requirements for next generation image forming apparatuses are described. It is described in the requirements that the warming-up time should not be greater than 10 seconds and the power consumption in a waiting state, which changes depending on the copying speed, should not be greater than 10–30 watt in a copier having a copy speed not less than 30 cpm (copies per minutes). In order to meet these requirements, the power consumption of copiers must be dramatically reduced.

In attempting to meet the requirements, fixing devices using a fixing element such as heat rollers, which has a low thermal capacity and which has a quick temperature rising time, are researched. However, the devices do not bring about the desirable effects.

Therefore, it is essential for satisfying the requirements to develop a toner which can be fixed at a low temperature, to decrease the fixing temperature of image forming apparatus. In order to meet the above-mentioned requirements, the image forming apparatus must decrease the fixing temperature by about 20° C. Therefore, a need exists for a toner having a fixing temperature lower than that of the conventional toners by 20° C. This is a hard problem, and cannot be solved by conventional techniques. This is because when a low temperature fixability is imparted to a toner, the fixable temperature range and preservation property of the toner deteriorate.

For example, Japanese Laid-Open Patent Publications Nos. 60-90344 and 3-229264 have disclosed toners having a low fixing temperature which include a resin or a wax having a low softening point. However, such toners tend to be blocked (i.e., a so-called blocking problem occurs) in a developing device in a copier, whose temperature is increased by the heat of a fixing device. In addition, such toners tend to be blocked when preserved under high temperature conditions, for example, when preserved in a warehouse without an air conditioner in a summer season. Further, such toners have a narrow fixing temperature range (i.e., such toners easily cause a hot offset problem)

Therefore, a toner exhibiting a combination of low temperature fixability and good preservation property has not yet be developed.

Recently, demands for high quality copies increase more and more. Images having good image qualities such as high resolution cannot be obtained by a conventional toner having a volume average particle diameter of from 10 to 15 $\mu$m. Therefore, a need exists for a toner having a relatively small average particle diameter. When a toner having a relatively small average particle diameter is used, various problems tend to occur. For example, an offset problem tends to occur in half tone images because the quantity of heat applied to the half tone toner images is extremely decreased when the toner particles of the toner image are present in a recess of a receiving paper.

Because of these reasons, a need exists for a toner having a combination of low temperature fixability, hot offset resistance and good preservation property.

SUMMARY OF THE INVENTION

Accordingly, an object of the present invention is to provide an electrophotographic toner having good low temperature fixability.

Another object of the present invention is to provide a toner having good hot offset resistance and good heat preservation property.

Yet another object of the present invention is to provide an image forming method and apparatus which can produce a copy upon application of relatively low heat energy without causing problems such as an offset problem.

Briefly these objects and other objects of the present invention as hereinafter will become more readily apparent can be attained by an electrophotographic toner including at least a binder resin, a colorant and a release agent, wherein the binder resin includes one or more components which are soluble in tetrahydrofuran, wherein the one or more components have a molecular weight distribution, which is measured by a GPC (gel permeation chromatography) method, such that at least one peak is present in a range of from 1,000 to 10,000, and wherein the peak has a half width not greater than 15,000, and preferably not greater than 10,000.

The binder resin preferably includes a polyester resin. In addition, the binder resin includes one or more chloroform-soluble components and one or more chloroform-insoluble components, wherein the amount of the chloroform-soluble components is greater than that of the chloroform-insoluble components.

The binder resin preferably includes two kinds of polyester resins, wherein the first resin has a relatively low molecular weight and the second polyester resin has a relatively high molecular weight, and wherein the second polyester resin is present in the first polyester resin like islands in a sea. Namely, the second resin forms one or more domains in the first resin. The softening point of the first polyester resin is preferably 25° C. or more lower than that of the second polyester resin.

In another aspect of the present invention, an electrophotographic image forming apparatus is provided which includes a toner bottle containing the toner mentioned above therein.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing(s) in which like reference characters designate like corresponding parts throughout and wherein.

DETAILED DESCRIPTION OF THE INVENTION

Figure 1:
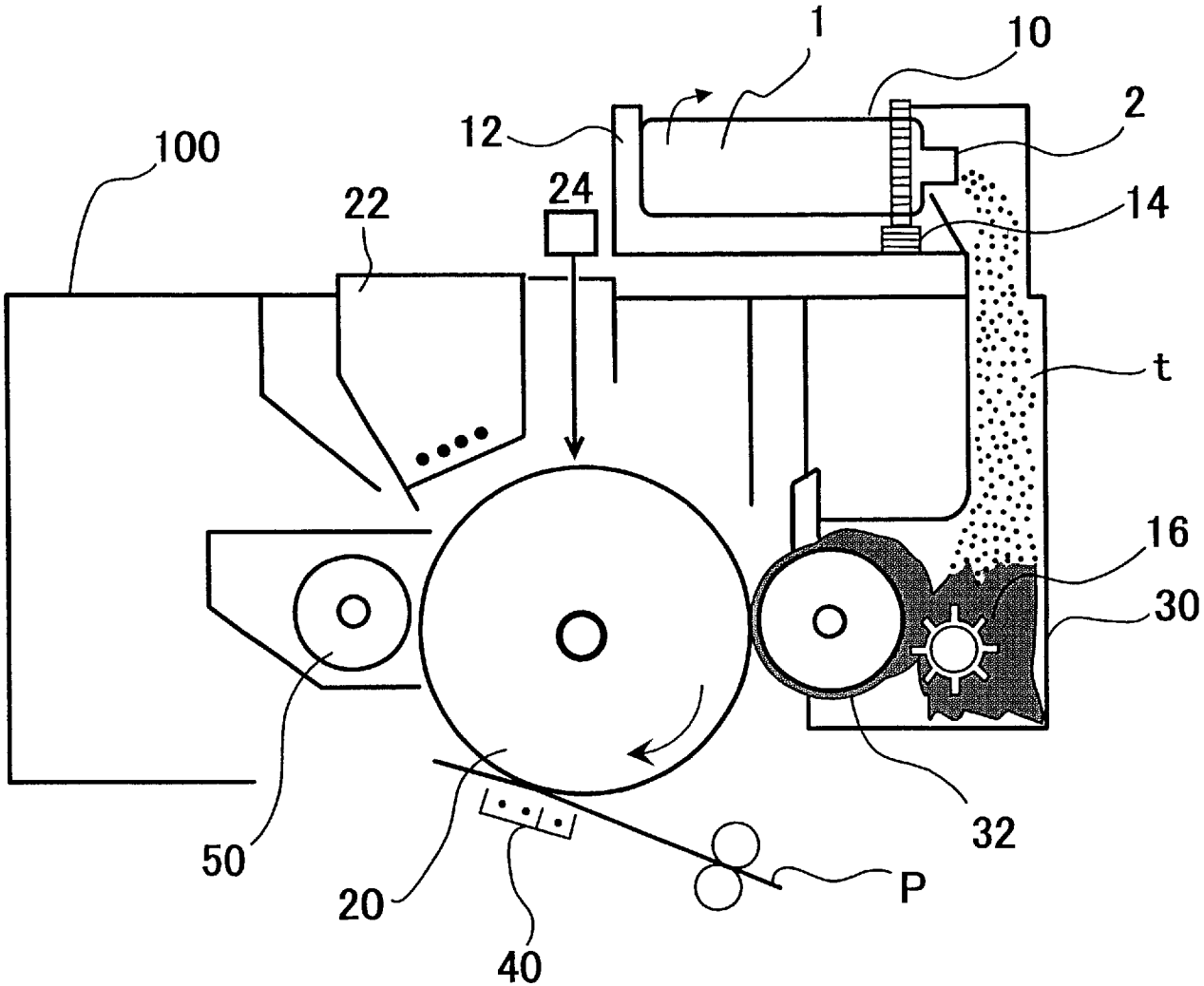
FIG. 1 is a schematic view illustrating an embodiment of the image forming apparatus of the present invention.

The present inventors have researched the binder resin of a toner to attain the first object of the present invention. As a result, it is discovered that by using a resin in which resin components having a relatively low molecular weight and a sharp molecular weight distribution are present in an amount as large as possible, the resultant toner has good low temperature fixability.

Generally, the present invention provides an electrophotographic toner including at least a binder resin, a colorant and a release agent, wherein the toner includes one or more components which are soluble in tetrahydrofuran (hereinafter referred to as THF) and which have a molecular weight distribution, which is measured by a GPC (gel permeation chromatography) method, and in which at least one peak is present in a range of from 1,000 to 10,000, and wherein the peak has a half width not greater than 15,000. The toner of the present invention has superior low temperature fixability.

In this case, the half width of the peak is more preferably not greater than 10,000 for achieving superior low temperature fixability.

The present inventors discover that the fixability of a toner rather depends on the THF-soluble components of the binder resin included in the toner than the THF-insoluble components. It is discovered that by using a binder resin which includes one or more THF-soluble components whose molecular weight distribution is controlled, a toner having the desired low temperature fixability.

The binder resin of the toner of the present invention is not particularly limited, and as mentioned later various resins can be used. Among the resins, polyester resins are preferable as binder resins.

In particular, it is preferable that at least two polyester resins whose softening points are different by 25° C. or more are used as binder resins. In addition, it is preferable that each of the polyester resins includes one or more THF-soluble components having a molecular weight distribution in which at least one peak is present between 1,000 to 10,000.

By using at least two polyester resins having different softening points, a toner having more superior low temperature fixability can be obtained more stably than in a case that only one polyester resin is used as a binder resin. The reason is considered to be that when two polyester resins are used, the molecular weight distribution of the low molecular weight components can be easily controlled, and therefore it is possible to increase the amount of the low molecular weight resin components having a sharp molecular weight distribution (i.e., to achieve good low temperature fixability) while good hot-offset resistance is maintained.

In addition, the present inventors discover that the hot-offset resistance and preservation property (i.e., heat resistance) of a toner depend on the amount of one or more components included in the toner, which are soluble in chloroform (hereinafter referred to as CF-soluble components), rather than the amount of CF-insoluble components.

It is preferable to include one or more CF-insoluble components in the binder resin in an amount as large as possible such that the resultant toner can maintain good lower temperature fixability. The amount of the CF-insoluble components included in the binder resin is preferably less than 50%, and more preferably from 5 to 40% by weight.

When the binder resin has such constitution, it can be avoided that the molecular weight distribution of the low molecular weight resin components of the binder resin is changed by cutting high molecular weight resin components in the kneading process of the toner manufacturing process. The toner of the present invention has a constitution such that the high molecular weight resin components are present as islands in a sea of the low molecular weight resin components. Namely, the high molecular weight resin components form one or more domains in the low molecular weight resin components. The high molecular weight resin components are present like islands while the components are not cut by shear force, and therefore the hot-offset resistance of the resultant toner can be improved.

When the toner includes two polyester resins having a different softening point as mentioned above, the resins also achieve the islands/sea state in which a high molecular weight components are present like islands in a sea of low molecular weight components. Therefore, hot offset resistance can be improved.

Conventionally, it is believed that the softening point (i.e., melting property) of a binder resin included in a toner rather depends on the chemical structure or conformation of the binder resin than the molecular weight of the binder resin. However, the present invention is made based on the discovery that the hot-offset resistance and preservation property of a toner can be dramatically improved by controlling the molecular weight of the binder resin constituting in the toner.

When the amount of low molecular weight components increase in a toner, the high molecular weight resin components are present as islands in a sea of the low molecular weight resin components in the kneading process of the toner manufacturing process. The shear force applied to the toner (binder resin) in the kneading operation can be absorbed in the melted low molecular weight components, and therefore the high molecular weight resin components, which are present as islands, can maintain their molecular weights without being cut, resulting in improvement of hot offset resistance of the resultant toner.

In addition, as a result of the examination of the present inventors based on the idea that by using a resin having a sharp molecular weight distribution as a binder resin, heat response of the resultant toner can be enhanced, a toner having a high level of hot offset resistance and preservation property can be obtained by controlling the molecular weight of the binder resin.

In the conventional toners having low temperature fixability, it is general to include a resin component having a middle molecular weight of from $10^5$ to $10^7$ in the toners to obtain a combination of low temperature fixability and hot offset resistance. Such toner shave good hot-offset resistance without deteriorating the low temperature fixability such that the toners can be used for the conventional image forming apparatus.

However, as mentioned above recently a need exists for a toner having a much higher level of low temperature fixability. The present inventors discover that to include a large amount of resin components having such a middle molecular weight (i.e., from $10^5$ to $10^7$) in a toner deteriorates the low temperature fixability of the toner. Therefore, it is discovered that by reducing the resin components having such a middle molecular weight as thoroughly as possible, namely by using a resin including resin components having a sharp molecular weight distribution as a binder resin, a toner having good heat response can be prepared. When a resin including only resin components having a low molecular weight is used as a binder resin, a toner having good hot-offset resistance cannot be prepared even if a releasing agent is added to the toner.

In the present invention, the hot-offset resistance can be maintained by using CF-insoluble resin components, which are in a gel state, together with the low molecular weight resin components, instead of resin components having a middle molecular weight. In the toner of the present invention, the middle molecular weight resin components, which conventional toners use for avoiding the hot offset problem but which tend to prevent the resultant toner from having good low temperature fixability, are reduced, and high molecular weight components (CF-insoluble components) are included instead. Therefore, the low temperature fixability of the toner can be improved while good hot-offset resistance is maintained.

When at least two kinds of polyester resins are used as binder resin in a toner, one (hereinafter referred to as polyester resin 1) of the polyester resins has a softening point of from 90 to 110° C. and includes one of benzenecarboxylic acids, benzenecarboxylic acid anhydrides, unsaturated dicarboxylic acids or unsaturated dicarboxylic acid anhydrides as a polycarboxylic acid constituent of the polyester resin. The other polyester resin (hereinafter referred to as polyester resin 2) preferably has a softening point of from 120 to 160° C. and includes one of benzenecarboxylic acids, benzenecarboxylic acid anhydrides, unsaturated dicarboxylic acids or unsaturated dicarboxylic acid anhydrides, which is different from the constituent of the polyester resin 1, as a polycarboxylic acid constituent of the polyester resin.

In order to impart a combination of good hot-offset resistance and good preservation to the toner, the softening point of the polyester resin 1 is preferably not lower than 90° C. In order to impart good low temperature fixability to the toner, the softening point of the polyester resin 1 is preferably not higher than 110° C.

In addition, in order to impart good hot-offset resistance to the toner, the softening point of the polyester resin 2 is preferably not lower than 120° C. In order to impart good low temperature fixability to the toner, the softening point of the polyester resin 2 is preferably not higher than 160° C.

Further, the polyester resins used for the toner of the present invention preferably have an acid value not less than 8 mgKOH/g to impart good low temperature fixability to the resultant toner. Furthermore, the polyester resins used for the toner of the present invention preferably have an acid value not greater than 45 mgKOH/g to impart good hot-offset resistance to the resultant toner.

Moreover, the polyester resins used for the toner of the present invention preferably have a hydroxyl value not greater than 50 mgKOH/g to impart good charge properties to the resultant toner.

It is preferable to use polyester resins which have a different polycarboxylic acid constituent because a wide fixable temperature range can be imparted to the resultant toner. This is because the polyester resins have poor compatibility with each other and therefore the polyester resins can easily achieve the islands/sea state in which the resin having a higher softening point is present as islands in a sea of the resin having a lower softening point. Accordingly, the resultant toner has a combination of good low temperature fixability and good hot-offset resistance.

In addition, salicylic acid metal compounds are useful for improving hot-offset resistance of the toner.

The particle diameter of the toner of the present invention is not particularly limited. However, the volume average particle diameter of the toner is preferably from 5 to 10 $\mu$m to obtain toner images having good image qualities such as high resolution.

The volume average particle diameter of a toner can be measured by various methods. In the present invention, the volume average particle diameter is measured by an instrument, Coulter Counter TAII manufactured by Coulter Electronics, Inc.

In the present invention, the molecular weight distribution of a resin is determined by a gel permeation chromatography (GPC) method.

The gel permeation chromatography method is as follows:

(1) a column is stabilized in a chamber heated to 40° C.;

(2) a solvent (i.e., tetrahydrofuran) is flowed through the column at a flowing speed of 1 ml/min; and (3) 50 to 200 $\mu$l of a tetrahydrofuran solution of a sample to be measured, in which the sample is present at a concentration of from 0.05 to 0.6% by weight, is injected to the column to determine the molecular distribution of the sample.

The same operations are performed with respect to several standard polystyrene resins, which have different molecular weights and each of which has a single molecular weight, to prepare a calibration curve. It is preferable to use at least about ten standard polystyrenes to prepare the calibration curve. Polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ which are manufactured by Pressure Chemical Co., or Tosoh Corp. are exemplified as the standard polystyrenes. In addition, an RI (refractive index) detector is used as the detector.

In the present invention, the concentration of CF-insoluble components in a resin is determined as follows:

(1) a resin sample of about 1 g is weighed, and added into chloroform of about 50 g to dissolve the resin;

(2) the solution is centrifuged, and then filtrated at room temperature using a filter paper of 5C specified in JIS P3801 (i.e., a filter paper capable of separating fine particles from the dispersion medium); and (3) the residue on the filter paper, which is the CF-insoluble components, is weighed after the chloroform in the residue is vaporized.

The concentration of the CF-insoluble components in a resin is determined by the following equation:

$$\text{Conc. (\% by weight)}=(WR/WI)\times 100$$

wherein WR represents the weight (g) of the residue, and WI represents the weight (g) of the resin sample.

The concentration of CF-insoluble components in a toner is determined by the same method as mentioned above. However, the residue includes solid materials such colorants etc., the concentration of the CF-insoluble resin components in the residue is determined by thermally analyzing the residue.

In the present invention, the glass transition temperature (Tg) of a binder resin is determinedby an instrument, Rigaku THERMOFLEX TG8110 manufactured by Rigaku Corporation. Measurements are performed under a condition of 10° C./min in temperature rising speed.

The acid value and the hydroxyl value of a resin are determined by a method based on JIS K0070.

The softening point of a binder resin is determined using a flow tester CFR-500 manufactured by Shimazu Corp. under the following conditions:

Sample amount: 1 $cm^2$;

Diameter of dice: 1 mm;

Pressure: 20 $kg/cm^2$; and

Temperature rising speed: 6° C./min;

The softening point is defined as follows:

$$\text{Softening point (°C.)}=(TS+TE)/2$$

wherein TS represents a flow starting temperature at which the sample resin melts and starts to flow, and TE is a flow ending temperature at which the sample resin of 1 $cm^2$ flows out.

The method for preparing the toner of the present invention is not particularly limited. Known manufacturing methods such as pulverizing methods, and polymerizing methods can be used. In addition, combination methods of the methods may be used.

Then the constitutional materials of the toner of the present invention will be explained.

Suitable polyester resins for use in the toner of the present invention include known polyester resins which can be prepared by condensation polymerization of one or more alcohols and one or more carboxylic acids.

Specific examples of the alcohols include glycols such as ethylene glycol, diethylene glycol, triethylene glycol and polypropylene glycol; etherized bisphenols such as 1,4-bis (hydroxymethyl) cyclohexane and bisphenol A; and polyhydric alcoholic monomers such as dihydric alcoholic monomers, and polyhydric alcoholic monomers having three or more hydroxy groups.

Specific examples of the carboxylic acids include dibasic acids such as maleic acid, fumaric acid, phthalic acid, isophthalic acid, terephthalic acid, succinic acid, and malonic acid; and polybasic carboxylic acids having three or more carboxyl groups, such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxyl propane, and 1,2,7,8-octanetetracarboxylic acid.

In the present invention, polyester resins having a glass transition temperature (Tg) not lower than 55° C., and preferably not lower than 60° C., are preferably used to impart good preservation property to the resultant toner.

In the present invention, polyester resins are preferably used as a binder resin. However, low temperature fixability can be achieved by using one or more resins other than polyester resins as the binder resin if the resins have the desired molecular weight distribution mentioned above.

In addition, when polyester resins are used, one or more other resins may be used in an amount such that the toner properties are not deteriorated.

Specific examples of such resins for use as the binder resin include styrene resins (i.e., homopolymers and copolymers of styrene and substitution products of styrene) such as polystyrene, polychlorostyrene, poly$\alpha$-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (e.g., styrene-methyl methacrylate copolymers, styrene-ethyl methacrylate copolymers, styrene-butyl methacrylate copolymers, and styrene-phenyl methacrylate copolymers), styrene-methyl $\alpha$-chloroacrylate copolymers, styrene-acrylonitrile-acrylate copolymers; vinyl chloride resins, rosin-modified maleic acid resins, phenolic resins, epoxy resins, polyethylene resins, polypropylene resins, ionomer resins, polyurethane resins, silicone resins, ketone resins, ethylene-ethyl acrylate copolymers, xylene resins, polyvinyl butyral resins, petroleum resins, hydrogenated petroleum resins, and the like resins.

Similarly to the case of polyester resins, the glass transition temperature of these resins is preferably not lower than 55° C., and more preferably not lower than 60° C., to prepare a toner having good preservation property.

The method for manufacturing these resins is not particularly limited. Know polymerization methods such as bulk polymerization methods, solution polymerization methods, emulsion polymerization, and suspension polymerization can be used.

Suitable materials for use as the colorant in the toner of the present invention include known pigments and dyes. Specific examples of the pigments and dyes include carbon black, lamp black, iron black, Aniline Blue, Phthalocyanine Blue, Phthalocyanine Green, Hansa Yellow G, Rhodamine 6C Lake, chalco oil blue, Chrome Yellow, Quinacridone Red, Benzidine Yellow, Rose Bengale, triaryl methane and the like. These pigments and dyes are used alone or in combination. The toner of the present invention may be a black toner or a color toner. The concentration of the colorant in the toner is from 1 to 30% by weight, and preferably from 3 to 20% by weight of the binder resin included in the toner.

Suitable release agent for use in the toner of the present invention include known release agents. Among the releasing agents, carnauba waxes which are subjected to a treatment in which free fatty acids are removed from the waxes, montan waxes, and oxidized rice waxes, and a combination thereof are preferably used. With respect to carnauba waxes, microcrystalline carnauba waxes are preferable. In addition, carnauba waxes having an acid value not greater than 5 mgKOH/g, and a property so as to be able to be dispersed in the toner as particles having a particle diameter not greater than 1 $\mu$m are preferable.

Montan waxes mean montan type waxes prepared by refining minerals. Montan waxes having microcrystals, and an acid value of from 5 to 14 mgKOH/g are preferably used.

Oxidized rice waxes can be prepared by air-oxidizing rice bran waxes. The acid value of oxidized waxes is preferably from 10 to 30 mgKOH/g.

In addition, solid silicone varnishes, higher fatty acids, higher alcohols, montan ester waxes, low molecular weight polypropylene waxes and the like known releasing agents can also be used alone or in combination as a release agent.

The concentration of the release agent in the toner is from 1 to 20 parts by weight, and preferably from 3 to 10 parts by weight, per 100 parts by weight of binder resin included in the toner.

The toner of the present invention may include additives such as charge controlling agents and fluidity improving agents.

Suitable charge controlling agents include known polarity controlling agents such as Nigrosine dyes, metal complex type dyes, and quaternary ammonium salts. These polarity controlling agents are used alone or in combination. The concentration of the charge controlling agent in the toner is from 0.1 to 10 parts by weight, and preferably from 1 to 5 parts by weight, per 100 parts by weight of the binder resin included in the toner.

In particular, metal complexes of salicylic acid and preferably complexes including a metal, which has three or more valence and whose coordination number is 6, are preferably used as charge controlling agents. These compounds can make a slightly-crosslinked structure by reacting with a functional group of a wax, and therefore a toner having good hot-offset resistance as well as good charge properties can be produced. Specific examples of metals having three or more valence include Al, Fe, Cr, and Zr.

Suitable fluidity improving agents for use in the toner of the present invention include known fluidity improving agents such as silica, titanium oxide, silicon carbide, aluminum oxide, and barium titanate. The concentration of the fluidity improving agents in the toner is from 0.1 to 5 parts by weight, and preferably from 0.5 to 2 parts by weight, per 100 parts by weight of the toner.

The toner of the present invention may be a magnetic toner which includes a magnetic material. Suitable magnetic materials for use in the toner include iron oxides such as magnetite, hematite and ferrite; metals such as iron, cobalt and nickel, and their metal alloys or mixtures with aluminum, copper, lead, magnesium, tin, zinc, antimony, beryllium, bismuth, cadmium, calcium, manganese, selenium, titanium, tungsten, vanadium, and the like; and the like. Among these compounds, magnetite is preferable because of having good magnetic properties.

The average particle diameter of the magnetic materials is preferably from 0.1 to 2 $\mu$m. The concentration of the magnetic material in the toner is 15 to 200 parts by weight, and preferably from 20 to 100 parts by weight, per 100 parts by weight of the binder resin included in the toner.

The toner of the present invention can be used as a one component developer and as a toner for two component developers in which the toner is mixed with a carrier.

Suitable materials for use as the carrier in the two component developer include known carrier materials such as magnetic powders, e.g., iron powders, ferrite powders, and nickel powders; beads such as glass beads; and the like.

These materials may be coated with a resin. Suitable resins useful for coating these carrier materials include styrene-acrylic copolymers, silicone resins, maleic acid resins, fluorine-containing resins, polyester resins, epoxy resins, and the like. When styrene-acrylic copolymers are used, copolymers including styrene repeating unit in an amount of from 30 to 90% by weight are preferably used to obtain a carrier having good charge imparting properties and good life. When carrier materials are coated with a resin coating liquid, the coating liquid may include additives such as tackifiers, hardeners, lubricants, electroconductive materials, charge controlling agents and the like.

When the toner of the present invention is used as a one component developer or a toner for two component developers, the toner is delivered to customers while being contained in a container. The toner container is used by being set in an image forming apparatus such as copiers and printers.

The container of the toner is not particularly limited. Any known containers such as bottle type containers and cartridge type containers can be used. In addition, the image forming apparatuses for which the toner of the present invention is used are also not particularly limited, and include known electrophotographic image forming apparatus such as copiers and printers.

FIG. 1 is a schematic view illustrating an image forming apparatus 100 useful for the image forming method of the present invention.

As shown in FIG. 1, a toner container 1 is horizontally and detachably set in a toner supplying device 10 of the image forming apparatus 100. The toner supplying device 10 includes a toner container supporting member 12 which supports a toner container 1 such that the opening 2 of the toner container leads to a toner supplying portion 16 in a developing device 30 of the image forming apparatus 100. In addition, the toner supplying device 10 includes a toner container rotating member 14 which rotates the toner container 1 such that the container 1 rotates around the center axis thereof. A toner t is discharged from the opening 2 toward the toner supplying portion 16.

As shown in FIG. 1, a layer of a developer including the toner t is formed on a developing roller 32. On the other hand, a photoreceptor 20 (i.e., an image bearing member) is charged with a charger 22. Then an imagewise light irradiating device 24 irradiates the charged photoreceptor with light to form an electrostatic latent image on the photoreceptor 20. The latent image is developed with the layer to form a toner image on the photoreceptor 20. The toner image is transferred to a receiving paper P using a transfer device 40. Then the photoreceptor 20 is cleaned with a cleaner 50. The toner image on the receiving paper P is fixed. Thus, a document is produced.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples 1 and 2

The following components were mixed using a Henshel mixer.

| | |
|---|---|
| Polyester resin A | 100 |
| Low molecular weight polypropylene (tradenamed as Viscol 550 P, manufactured by Sanyo Chemical Industries Ltd.) | 5 |
| Carbon black (tradenamed as #44, manufactured by Mitsubishi Chemical Corp.) | 10 |
| Azo compound including a metal | 1 |

As shown in Table 3, the main peak in the molecular weight distribution curve of the binder resin (polyester resin A) was observed at 8,000 and the half width of the peak was 13,000. In addition, the acid and alcohol constituents of the polyester resin A are shown in Table 1.

The mixture was heated at a temperature of from 130 to 140° C. and kneaded for about 30 minutes using a roll mill. The kneaded mixture was cooled to room temperature, and then pulverized using a pulverizer such as jet mills. The pulverized mixture was classified using an air classifier. Thus, mother toners having a volume average particle diameter of 11.5 (Example 1) and 7.5 μm (Example 2) were prepared. A hydrophobic silica was added to each of the thus prepared mother toners in an amount of 0.5% by weight. Thus toners of Examples 1 and 2 were prepared.

Comparative Example 1

The procedure for preparation of the toner of Example 2 was repeated except that polyester resin A was replaced with a polyester resin B.

As shown in Table 3, the main peak in the molecular weight distribution curve of the binder resin (polyester resin B) was observed at 11,000 and the half width of the peak was 300,000.

Thus, a toner of Comparative Example 1 was prepared.

Example 3

The procedure for preparation of Example 2 was repeated except that the formulation of the toner was as follows:

| | |
|---|---|
| Polyester resin C | 100 |
| Oxidized rice wax | 5 |
| Carbon black (tradenamed as #44, manufactured by Mitsubishi Chemical Corp.) | 10 |
| Quaternary ammonium salt compound | 1 |

As shown in Table 3, the main peak in the molecular weight distribution curve of the binder resin (polyester resin C) was observed at 7,800 and the half width of the peak was 12,000.

Thus, a toner of Example 3 was prepared.

Example 4

The procedure for preparation of Example 2 was repeated except that the formulation of the toner was as follows:

| | |
|---|---|
| Polyester resin D | 50 |
| Polyester resin E | 50 |

-continued

| | |
|---|---|
| Carnauba wax (subjected to a treatment in which free fatty acids were removed from the wax) | 5 |
| Carbon black (tradenamed as #44, manufactured by Mitsubishi Chemical Corp.) | 10 |
| Azo compound including a metal | 1 |

As shown in Table 3, the main peak in the molecular weight distribution curve of the binder resin (the mixture of polyester resins D and E) was observed at 6,000 and the half width of the peak was 10,000.

Thus, a toner of Example 4 was prepared.

Example 5

The procedure for preparation of Example 4 was repeated except that polyester resin E was replaced with a polyester resin F and the volume average particle diameter was changed to 6.5 μm.

As shown in Table 3, the main peak in the molecular weight distribution curve of the binder resin (the mixture of polyester resins D and F) was observed at 5,900 and the half width of the peak was 9,800.

Thus, a toner of Example 5 was prepared.

Example 6

The procedure for preparation of Example 4 was repeated except that the azo compound including a metal was replaced with a Zr (IV) complex of salicylic acid.

As shown in Table 3, the main peak in the molecular weight distribution curve of the binder resin (the mixture of polyester resins D and E) was observed at 5,900 and the half width of the peak was 9,900.

Thus, a toner of Example 6 was prepared.

Example 7

The procedure for preparation of Example 4 was repeated except that the average particle diameter was 9.5 μm, and the formulation of the toner was as follows:

| | |
|---|---|
| Polyester resin G | 45 |
| Polyester resin H | 45 |
| Styrene-acrylic resin (the resin had a weight average molecular weight of 25,800, a Tg of 65° C., a concentration of CF-insoluble materials of 3% and a softening point of 140° C., and a peak in the molecular weight distribution was observed at 4,200) | 15 |
| Carnauba wax (which had been subjected to a treatment in which free fatty acids were removed from the wax) | 5 |
| Carbon black (tradenamed as #44, manufactured by Mitsubishi Chemical Corp.) | 10 |
| Fe (III) complex of salicylic acid | 1 |

As shown in Table 3, the main peak in the molecular weight distribution curve of the binder resin (the mixture of polyester resins G and H, and the styrene-acrylic resin) was observed at 6,100 and the half width of the peak was 11,000.

Thus, a toner of Example 7 was prepared.

Example 8

The procedure for preparation of Example 2 was repeated except that the formulation of the toner was as follows:

| | |
|---|---|
| Polyester resin I | 45 |
| Polyester resin J | 45 |
| Styrene-methyl methacrylate resin (the resin had a weight average molecular weight of 20,000, a Tg of 65° C., a concentration of CF-insoluble materials of 5% and a softening point of 135° C., and a peak in the molecular weight distribution was observed at 6,300.) | 10 |
| Oxidized rice wax (acid value of 15) | 5 |
| Carbon black (tradenamed as #44, manufactured by Mitsubishi Chemical Corp.) | 8 |
| Azo dye including a metal (tradenamed as S-34 manufactured by Orient Chemical Industries Co., Ltd.) | 2 |

As shown in Table 3, the main peak in the molecular weight distribution curve of the binder resin (the mixture of polyester resins I and J, and the styrene-methyl methacrylate resin) was observed at 5,500 and the half width of the peak was 9,000.

Thus, a toner of Example 8 was prepared.

Example 9

The procedure for preparation of the toner of Example 8 was repeated except that polyester resin J was replaced with a polyester resin K.

The main peak in the molecular weight distribution curve of the binder resin was observed at 5,600 and the half width of the peak was 9,300.

Thus, a toner of Example 9 was prepared.

Example 10

The procedure for preparation of the toner of Example 8 was repeated except that polyester resin I was replaced with a polyester resin L.

The main peak in the molecular weight distribution curve of the binder resin was observed at 5,700 and the half width of the peak was 9,400.

Thus, a toner of Example 10 was prepared.

Example 11

The procedure for preparation of the toner of Example 8 was repeated except that polyester resin I was replaced with a polyester resin M.

The main peak in the molecular weight distribution curve of the binder resin was observed at 5,500 and the half width of the peak was 9,600.

Thus, a toner of Example 11 was prepared.

Example 12

The procedure for preparation of the toner of Example 8 was repeated except that polyester resin J was replaced with a polyester resin N.

The main peak in the molecular weight distribution curve of the binder resin was observed at 5,400 and the half width of the peak was 9,400.

Thus, a toner of Example 12 was prepared.

Example 13

The procedure for preparation of the toner of Example 8 was repeated except that polyester resin J was replaced with a polyester resin O.

The main peak in the molecular weight distribution curve of the binder resin was observed at 5,600 and the half width of the peak was 9,300.

Thus, a toner of Example 13 was prepared.

Example 14

The procedure for preparation of the toner of Example 8 was repeated except that polyester resin I was replaced with a polyester resin P.

The main peak in the molecular weight distribution curve of the binder resin was observed at 8,200 and the half width of the peak was 13,000.

Thus, a toner of Example 14 was prepared.

Example 15

The procedure for preparation of the toner of Example 8 was repeated except that polyester resin I was replaced with a polyester resin Q.

The main peak in the molecular weight distribution curve of the binder resin was observed at 4,800 and the half width of the peak was 9,000.

Thus, a toner of Example 15 was prepared.

Example 16

The procedure for preparation of the toner of Example 8 was repeated except that polyester resin J was replaced with a polyester resin R.

The main peak in the molecular weight distribution curve of the binder resin was observed at 8,200 and the half width of the peak was 12,000.

Thus, a toner of Example 16 was prepared.

Example 17

The procedure for preparation of the toner of Example 8 was repeated except that polyester resin J was replaced with a polyester resin S.

The main peak in the molecular weight distribution curve of the binder resin was observed at 5,100 and the half width of the peak was 8,800.

Thus, a toner of Example 17 was prepared.

The thus prepared toners were evaluated by the following methods:

(1) Fixing property

A toner was set in a copier tradenamed as MF 2200 manufactured by Ricoh Co., Ltd., whose fixing unit was modified and in which a Teflon-coated roller was used as a fixing roller, and a toner image was formed on a receiving paper tradenamed as copy paper type 6200 manufactured by Ricoh Co., Ltd.

The toner image was fixed while changing the fixing temperature of the fixing roller to determine the cold-offset temperature (i.e., a minimum fixing temperature) and hot-offset temperature (i.e., a fixing temperature above which a hot offset problem occurs). Thus the low temperature fixability and hot-offset resistance of the toner were evaluated. The minimum fixing temperature of conventional low temperature fixable toners is from about 140 to 150° C.

The fixing conditions when the low temperature fixability was evaluated were as follows:

Paper feeding speed: 120 to 150 mm/sec

Pressure of fixing roller: 1.2 Kgf/cm$^2$

Nip width of the fixing area: 3 mm

The fixing conditions when the hot-offset resistance was evaluated were as follows:

Paper feeding speed: 50 mm/sec

Pressure of fixing roller: 2.0 Kgf/cm$^2$

Nip width of the fixing area: 4.5 mm

The low temperature fixability was classified into the following 5 grades:

◎: the minimum fixing temperature is lower than 130° C.

○: the minimum fixing temperature is from 130 to 140° C.

□: the minimum fixing temperature is from 140 to 150° C.

Δ: the minimum fixing temperature is from 150 to 160° C.

×: the minimum fixing temperature is higher than 160° C.

The hot-offset resistance was classified into the following 5 grades:

◎: the hot-offset temperature is not lower than 201° C.

○: the hot-offset temperature is from 200 to 191° C.

□: the hot-offset temperature is from 190 to 181° C.

Δ: the hot-offset temperature is from 180 to 171° C.

×: the minimum fixing temperature is not higher than 170° C.

(2) Preservation property

Twenty (20) grams of a toner was contained in a glass container of 20 ml. The glass container was tapped 50 times to condense the toner. The glass container including the toner was preserved for 24 hours in a chamber in which the temperature was controlled at 50° C. Then the glass container was cooled to room temperature. The penetration of the toner was measured using a penetration tester. The preservation resistance was classified into the following 5 grades:

◎: the penetration is indefinite (i.e., the needle penetrated throughout the toner layer ○: the penetration is greater than 25 mm □: the penetration is from 25 to 20 mm Δ: the penetration is from 20 to 15 mm ×: the penetration is less than 15 mm The formulation and physical properties of polyester resins A–S are shown in Tables 1 and 2. In addition, the evaluation results are shown in Table 3.

TABLE 1

| | | Polyester resin | | | | | | | | | |
|---|---|---|---|---|---|---|---|---|---|---|---|
| | | A | B | C | D | E | F | G | H | I | J |
| Acid Comp | TPA | ○ | ○ | | | | ○ | ○ | | ○ | |
| | IPA | | | | | ○ | | | ○ | | |
| | FA | | | ○ | ○ | | | | | | ○ |
| | DSA | ○ | ○ | | | | ○ | ○ | | ○ | |
| | TAA | ○ | ○ | ○ | ○ | ○ | ○ | ○ | ○ | ○ | |
| Al-co-hol comp | BAP | ○ | ○ | ○ | ○ | ○ | ○ | ○ | ○ | ○ | ○ |
| | BAE | ○ | ○ | ○ | ○ | ○ | ○ | ○ | ○ | ○ | ○ |
| Physical properties | Me | 11,000 | 104,100 | 10,000 | 5,000 | 6,000 | 6,100 | 5,100 | 5,800 | 5.200 | 10,000 |
| | Mp | 5,800 | 15,000 | 5,800 | 4,000 | 3,500 | 3,600 | 4,100 | 3,600 | 3,400 | 7,600 |
| | AV | 23 | 20 | 26 | 20 | 47 | 40 | 32 | 34 | 36 | 25 |
| | HV | 40 | 38 | 35 | 40 | 42 | 45 | 41 | 45 | 32 | 36 |
| | SP | 140 | 141 | 137 | 100 | 145 | 151 | 98 | 145 | 95 | 140 |
| | Tg | 67 | 66 | 62 | 63 | 61 | 62 | 63 | 61 | 64 | 61 |
| | CF-INS | 25 | 5 | 8 | 0 | 8 | 30 | 0 | 20 | 0 | 21 |
| Resin type | | | | | PE1 | PE2 | PE2 | PE1 | PE2 | PE1 | PE2 |

TPA: Terephthalic acid
IPA: Isophthalic acid
FA: Fumaric acid
DSA: Dodecenylsuccinic acid anhydride
TAA: Trimellitic acid anhydride
BAP: Bisphenol A (2,2) propylene oxide
BAE: Bisphenol A (2,2) ethylene oxide
Mw: Weight average molecular weight
Mp: Peak molecular weight
AV: Acid value (mgKOH/g)
HV: Hydroxyl value (mgKOH/g)
Sp: Softening point (° C.)
Tg: Glass transition temperature (° C.)
CF-INS: Content of materials insoluble in chloroform (% by weight)
PE1: Polyester resin 1
PE2: Polyester resin 2

TABLE 2

| | | Polyester resin | | | | | | | | |
|---|---|---|---|---|---|---|---|---|---|---|
| | | K | L | M | N | ○ | P | Q | R | S |
| Acid Comp | TPA | ○ | ○ | ○ | | | ○ | ○ | | |
| | IPA | | | | | | ○ | | | |
| | FA | | | | ○ | ○ | | | ○ | ○ |
| | DSA | ○ | ○ | ○ | | | ○ | ○ | | |

TABLE 2-continued

| | | Polyester resin | | | | | | | | |
|---|---|---|---|---|---|---|---|---|---|---|
| | | K | L | M | N | ○ | P | Q | R | S |
| Alcohol comp | TAA | ○ | ○ | ○ | ○ | ○ | ○ | ○ | | ○ |
| | EG | | | | | | | | | ○ |
| | BAP | ○ | ○ | ○ | ○ | ○ | ○ | ○ | ○ | ○ |
| | BAE | ○ | ○ | ○ | ○ | ○ | ○ | ○ | ○ | ○ |
| Physical properties | Mw | 8,000 | 5,300 | 5,500 | 11,000 | 9,800 | 7,000 | 5,000 | 13,000 | 9,000 |
| | Mp | 6,000 | 3,300 | 4,000 | 7,700 | 7,500 | 4,500 | 4,000 | 8,900 | 6,400 |
| | AV | 27 | 48 | 40 | 47 | 40 | 35 | 34 | 38 | 28 |
| | HV | 34 | 39 | 55 | 42 | 54 | 30 | 28 | 35 | 38 |
| | SP | 137 | 100 | 101 | 141 | 142 | 120 | 87 | 164 | 113 |
| | Tg | 62 | 62 | 63 | 60 | 62 | 65 | 62 | 61 | 60 |
| | CF-INS | 23 | 0 | 0 | 18 | 23 | 0 | 0 | 23 | 13 |
| Resin type | | PE2 | PE1, Large AV | PE1, Large HV | PE2, Large AV | PE2, Large HV | PE1, High SP | PE1, Low SP | PE2, High SP | PE2, Low SP |

TABLE 3

| | VAPD (μm) | MP | HW | CF-INS (%) | Low temp. fixability | Hot-off-set resistance | Preservation property | Resolution of image |
|---|---|---|---|---|---|---|---|---|
| Ex. 1 | 11.5 | 8,000 | 13,000 | 20 | ○ | ○ | □ | □ |
| Ex. 2 | 7.5 | 8,000 | 13,000 | 20 | ○ | ○ | □ | ◎ |
| Ex. 3 | 7.5 | 7,800 | 12,000 | 2 | ○ | □ | □ | ◎ |
| Ex. 4 | 7.5 | 6,000 | 10,000 | 14 | ◎ | □ | ○ | ◎ |
| Ex. 5 | 6.5 | 5,900 | 9,800 | 14 | ◎ | ◎ | ○ | ◎ |
| Ex. 6 | 7.5 | 5,900 | 9,900 | 15 | ◎ | ◎ | ○ | ◎ |
| Ex. 7 | 9.5 | 6,100 | 11,000 | 9 | ◎ | ◎ | ◎ | ○ |
| Ex. 8 | 7.5 | 5,500 | 9,000 | 9 | ◎ | ○-◎ | ○ | ◎ |
| Ex. 9 | 7.5 | 5,600 | 9,300 | 5 | □-○ | ○ | ○ | ◎ |
| Ex. 10 | 7.5 | 5,700 | 9,400 | 9 | ○ | Δ | ○ | ◎ |
| Ex. 11 | 7.5 | 5,500 | 9,600 | 10 | ○ | ○-◎ | ○ | ◎ |
| Ex. 12 | 7.5 | 5,400 | 9,400 | 6 | ○ | X-Δ | ○ | ◎ |
| Ex. 13 | 7.5 | 5,600 | 9,300 | 11 | ○ | ○-◎ | ○ | ◎ |
| Ex. 14 | 7.5 | 8,200 | 13,000 | 9 | □ | ○-◎ | ○ | ◎ |
| Ex. 15 | 7.5 | 4,800 | 9,000 | 9 | ◎ | X-Δ | ○ | ◎ |
| Ex. 16 | 7.5 | 8,200 | 12,000 | 11 | □ | ○-◎ | ○ | ◎ |
| Ex. 17 | 7.5 | 5,100 | 8,800 | 6 | ◎ | X-Δ | ○ | ◎ |
| Comp. Ex. 1 | 7.5 | 11,000 | 300,000 | 0 | □ | □ | □ | ◎ |

VAPD: Volume average particle diameter of the toner
MP: Main peak molecular weight of the binder resin included in the toner
HW: Half width of the peak in the molecular weight distribution curve
CF-INS: Concentration of chloroform-insoluble materials in the toner As can be understood from Table 3, the toners of the present invention, particularly the toners of Examples 5–8 have a combination of good low temperature fixability, good hot-offset resistance, and good preservation property.

This document claims priority and contains subject matter related to Japanese Patent Applications Nos. 11-170396 and 11-283641, filed on Jun. 17, 1999, and Oct. 5, 1999, respectively, incorporated herein by reference.

Having now fully described the invention, it will be apparent to one of ordinary skill in the art that many changes and modifications can be made thereto without departing from the spirit and scope of the invention as set forth therein.

What is claimed a new and desired to be secured by Letters Patent of the United State is:

1. An electrophotographic toner comprising a binder resin, a colorant, and a releasing agent, wherein the binder resin comprises one or more components soluble in tetrahydrofuran, wherein the one or more components have a molecular weight distribution such that at least one peak is present between 1,000 and 10,000, wherein the peak has a half width not greater than 15,000, and wherein the binder resin further comprises one or more components insoluble in chloroform.

2. The toner according to claim 1, wherein the half width is not greater than 10,000.

3. The toner according to claim 1, wherein the binder resin comprises a polyester resin.

4. The toner according to claim 3, wherein the polyester resin has an acid value ranging from 8 to 45 mgKOH/g and a hydroxy value not greater than 50 mgKOH/g.

5. The toner according to claim 1, wherein the one or more components insoluble in chloroform are present in the binder resin in an amount less than 50% by weight.

6. The toner according to claim 5, wherein the one or more components insoluble in chloroform are present in the binder resin in an amount ranging from 5 to 40% by weight.

7. The toner according to claim 1, wherein the binder resin achieves an island/sea state in which one or more components having a relatively low molecular weight constitute the sea state and one or more components having a relatively high molecular weight constitute the island state.

8. The toner according to claim 1, wherein the binder resin comprises at least two resins A and B, said resin A having a softening point A and comprising one or more components A soluble in tetrahydrofuran, said resin B having a softening point B and comprising one or more components B soluble in tetrahydrofuran, and wherein the softening point A is higher than the softening point B by 25° C. or more, and each of said one or more components A and B has a molecular weight distribution such that at least one peak is present between 1,000 and 10,000.

9. The toner according to claim 8, wherein the resin A comprises a polyester resin 2 having a softening point ranging from 120 to 160° C. and the polyester resin B comprises apolyester resin 1 having a softening point ranging from 90 to 110° C.

10. The toner according to claim 9, wherein said polyester resin 1 comprises an acid constituent 1 selected from the group consisting of benzenecarboxylic acids, benzenecarboxylic acid anhydrides, unsaturated dicarboxylic acids, and unsaturated dicarboxylic acid anhydrides, and the polyester resin 2 comprises an acid constituent 2 selected from the group consisting of benzenecarboxylic acid anhydrides, unsaturated dicarboxylic acids, and unsaturated dicarboxylic acid anhydrides, and wherein the acid constituents 1 and 2 of polyesters 1 and 2 are different from each other.

11. The toner according to claim 9, wherein each of the polyester resins A and B has an acid value ranging from 8 to 45 mgKOH/g and a hydroxy value not greater than 50 mgKOH/g.

12. The toner according to claim 1, wherein the toner further comprises a salicylic acid metal compound.

13. The toner according to claim 1, wherein the toner further comprises a release agent selected from the group consisting of carnauba waxes which are subjected to a treatment in which free fatty acids are removed from the carnauba waxes, montan waxes and oxidized rice waxes.

14. The toner according to claim 1, wherein the toner has a volume average particle diameter ranging from 5 to 10 $\mu$m.

15. A toner container comprising the electrophotographic toner according to claim 1.

16. A method of making a toner container, the method comprising placing toner in a toner container; and forming the toner container of claim 15.

17. An electrophotographic image forming apparatus comprising:

an image bearing member which bears an electrostatic latent image thereon; and an electrophotographic toner, which develops the electrostatic latent image into a toner image, wherein the toner is the toner according to claim 1.

18. A method of making an electrophotographic image forming apparatus, the method comprising setting a toner container in an electrophotographic image forming apparatus; and forming the electrophotographic image forming apparatus of claim 17.

19. A method of forming an electrophotographic image comprising the steps of:

forming an electrostatic latent image on an image bearing member; and developing the electrostatic latent image with the electrophotographic toner according to claim 1, thereby forming a toner image.

20. A method of making a toner, the method comprising mixing a binder resin, a colorant, and a releasing agent; and forming the toner of claim 1.

* * * * *